United States Patent [19]

Podszun et al.

[11] Patent Number: 4,631,243

[45] Date of Patent: Dec. 23, 1986

[54] ELECTROSTATOGRAPHIC SUSPENSION DEVELOPER AND A PROCESS FOR THE PRODUCTION THEREOF

[75] Inventors: Wolfgang Podszun; John Goossens, both of Cologne; Carlhans Süling, Odenthal, all of Fed. Rep. of Germany; Herman Uytterhoeven, Bonheiden; Walter de Winter, Grafenwezen, both of Belgium; Günther Hoffarth, Leverkusen; Wolfgang Richter, Krefeld, both of Fed. Rep. of Germany

[73] Assignee: Agfa Gevaert Aktiengesellschaft, Leverkusen, Fed. Rep. of Germany

[21] Appl. No.: 752,086

[22] Filed: Jul. 5, 1985

[30] Foreign Application Priority Data

Jul. 17, 1984 [DE] Fed. Rep. of Germany ..... 3426198

[51] Int. Cl.[4] ..... G03G 9/12

[52] U.S. Cl. ..... 430/114; 430/115

[58] Field of Search ..... 430/113, 114, 904

[56] References Cited

FOREIGN PATENT DOCUMENTS 51-13584 4/1976 Japan ..... 430/114

95543 6/1984 Japan ..... 430/114

*Primary Examiner*—John D. Welsh

*Attorney, Agent, or Firm*—Connolly and Hutz

[57] ABSTRACT

An electrostatographic suspension developer contains, in an electrically insulating carrier liquid with a volume resistivity of at least $10^9$ Ohm. cm and a dielectric constant of below 3, a dispersed pigment and a polymer of basic secondary or tertiary amino group-containing monomers, the amino groups of which are completely or partially neutralized with a Bronsted acid, which contains at least one hydrocarbon radical having from 6 to 24 carbon atoms, and optionally further comonomers.

12 Claims, No Drawings

ELECTROSTATOGRAPHIC SUSPENSION DEVELOPER AND A PROCESS FOR THE PRODUCTION THEREOF

This invention relates to an improved electrostatic suspension developer which contains a basic polymer and a Bronsted acid for the production of a positive toner charge as well as a process for the production thereof.

Dry developing and wet developing processes are known for developing electrostatic images on electrostatographic recording materials. The wet developing processes using suspension developers are superior to the dry developing processes regarding edge definition and resolving power.

Suspension developers generally consist of a highly-insulating carrier liquid, a pigment, a charge control agent and a polymer. The carrier liquid preferably has a volume resistivity of at least $10^9$ Ohm.cm and a dielectric constant of below 3. Usual azo dyes, xanthene dyes, phthalocyanine dyes, as described inter alia in DE-OS No. 29 44 021, but also triphenylmethane dyes, acridine dyes or quinoline dyes are used as pigments. Carbon black pigments are preferably used as black pigments.

The polymer has in the first place the object of giving the pigment dispersion a sufficient seteric stabilisation and guaranteeing adhesion or fixing of the pigment particles to the image carrier.

Numerous polymers of various structures can be used as a component of electrostatographic suspension developers. Thus, the use of statistical copolymers, which are formed from weakly polar monomers (e.g. $C_6$–$C_{20}$-alkyl(meth)acrylate) and more strongly polar monomers (e.g. aminomethacrylates or vinylpyrrolidone), has been described many times (e.g. DE-A No. 19 27 592, DE-A No. 19 38 001, BE-A No. 784 367, JP-A No. 49 129 539 or JP-A No. 73 431 54). The use of styrene-butadiene copolymers is likewise possible (e.g. DE-A No. 23 37 419, DE-A No. 24 52 499 or JP-A No. 73 290 72).

Various graft copolymers have also been used for forming suspension developers (e.g. No. DE-A 20 42 804, DE-A No. 21 03 045, DE-A No. 24 21 037, DE-A No. 25 32 281, DE-A No. 24 32 288, DE-A No. 29 35 287, GB-A No. 2 157 2343, GB-A No. 2 029 049 or U.S. Pat. No. 4,033,890). It is known from DE-A No. 32 32 062 that the pigment particles of a suspension developer can be stabilised sterically by forming a cross-linked polymer sheath by means of precipitation polymerisation.

In so far as the polymers contain ionic groups, these can play a part in forming the toner charge. The charging of the toner particles is generally, however, produced by oil-soluble ionogenic compounds, for example by metal salts of organic acids with long aliphatic radicals. Thus, carbon black pigments, for example, can be positively charged in liquid isoparaffin by organic phosphorus compounds (GB-A No. 1 151 141). A negative charge accumulation is possible by addition of basic metal alkyl sulphonates (GB-A No. 1 571 401).

A disadvantage of using the known charge-determining substances is that the electrical properties of the suspension developers, such as conductivity and particle charge, are not stable to changes in concentration and are influenced to a high degree by traces of water (e.g. atmospheric moisture). Furthermore, such suspension developers generally show a high electrical conductivity of the dispersion medium, the electrophoretic deposition of the toner particles thereby being adversely affected.

An object of the invention is thus to produce an electrostatographic suspension developer with positive toner charge and improved charge stability.

This object is achieved according to the invention by a suspension developer which contains a dispersed pigment and a polymer with secondary or tertiary amino groups in an electrically insulating carrier liquid with a volume resistivity of at least $10^9$ Ohm.cm and a dielectric constant of below 3, the secondary or tertiary amino groups being completely or partially neutralised by a Bronsted acid with at least one $C_6$–$C_{24}$-hydrocarbon group.

Hydrocarbons, fluorohydrocarbons or silicone oil can be used as the carrier liquid with a volume resistance of at least $10^9$ Ohm.cm and a dielectric constant of below 3. Liquids based on hydrocarbons are preferred, for example aromatic hydrocarbons such as benzene, toluene or xylenes or aliphatic $C_6$–$C_{15}$-hydrocarbons such as n-hexane, cyclohexane, n-heptane, n-octane or decalin. Mixtures of different hydrocarbons can also be used. Branched aliphatic hydrocarbons such as isodecane and isododecane are particularly suitable.

The aforementioned black and coloured pigments normally used for suspension developers are suitable as pigments.

Spirit black (C.I.no.50415), aniline black (C.I.no. 50440), cyanine blue (C.I.no.74250), brilliant carmine 6B (C.I. 15850), parared (C.I.no.15 865), benzidine orange (C.I.21110) or permanent yellow GR 52 (C.I.21100) are, for example, well suited.. Particularly preferred are carbon black (above all basic carbon black types), helio-fast blue HG (C.I.no. 74160), fanal pink B (C.I.no.45160) and helio fast yellow GRN (C.I.-no.211000).

The polymer with secondary or tertiary amino groups can be a homo- or copolymer. It may consist of from 1 to 100% by weight, preferably from 10 to 70% by weight, of basic monomers corresponding to the general formulae I to III:

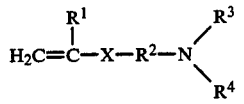

I

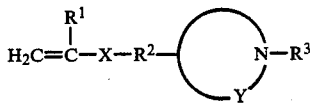

II

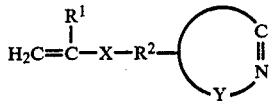

III wherein:

$R^1$=a hydrogen atom or a $CH_3$-group, $R^2$=a hydrocarbon radical having from 1 to 18 carbon atoms, $R^3$=a hydrogen atom or a hydrocarbon radical having from from 1 to 18 carbon atoms, $R^4$=a hydrocarbon radical having from 1 to 18 carbon atoms, or $R_3$ and $R_4$ together represent the atoms necessary for forming a 5- or 6-membered heterocyclic ring, X = one of the groups $$-\overset{O}{\overset{\|}{C}}-O-,\quad -\overset{O}{\overset{\|}{C}}-\overset{H}{\overset{|}{N}}-,\quad -O-\overset{O}{\overset{\|}{C}}-\quad \text{or}\quad -CH_2-O-\overset{O}{\overset{\|}{C}}-$$

Y = the atoms necessary for the completion of a heterocyclic 5- or 6-membered ring.

The hydrocarbon radicals referred to can be straight or branched alkyl-, aryl-, arylalkyl- or alkyl-aryl radicals.

Examples of basic monomers of the given general formulae I to III are:

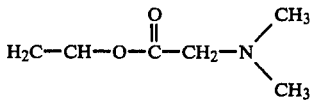

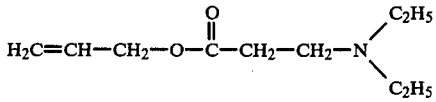

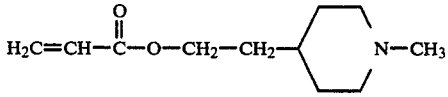

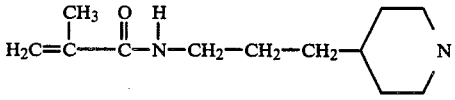

Preferred basic monomers are derivatives of acrylic acid and methacrylic acid corresponding to the formulae IV and V:

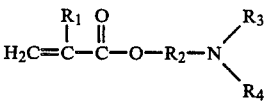

IV

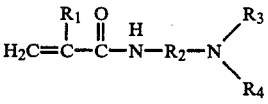

V wherein $R_1$, $R_2$, $R_3$ and $R_4$ are as defined above.

The following are named as examples of preferred basic monomers: dimethylaminoethyl(meth)acrylate, diethylaminoethyl(meth)acrylate, 3-dimethylamino-2,2-dimethylpropyl(meth)acrylate, tert.-butylaminoethyl(meth)acrylate or 3-dimethylaminopropyl(meth)acrylamide.

The term (meth)acrylate here represents acrylate or methacrylate. The specified basic monomers can be copolymerised with radically polymerisable, olefinically unsaturated comonomers. Vinyl and vinylidene compounds are most suitable. The following are named as examples:

(meth)acrylic acid esters, (meth)acrylic acid amide, (meth)acrylonitrile; vinyl esters such as vinyl acetate, vinylpropionate; vinyl aromatic materials such as styrene or α-methyl styrene; moreover dienes such as butadiene and isoprene as well as halogen-containing monomers such as vinyl chloride and vinylidene chloride. Preferred comonomers are (meth)-acrylic acid esters having at least one $C_1$-to-$C_{24}$ hydrocarbon radical in the alcohol moiety and styrene. Mixtures of different monomers are also well suited. Good rates of incorporation are especially achieved if (meth)acrylic acid esters are at least partly used as comonomers. Both non-cross-linked copolymers and copolymers cross-linked by using polyfunctional monomers such as ethylene dimethyl acrylate or divinyl benzene can be formed.

It is possible to give the polymer improved dispersion properties by using suitable comonomers. In this case, the polymer increases the dispersion stability of the pigment dispersion by steric screening. Comonomers which improve the dispersion properties of the polymer are, for example, vinyl or vinylidine monomers with one hydrocarbon radical having from 6 to 24 carbon atoms such as stearyl(meth)acrylate, lauryl(meth)-acrylate or 2-ethylhexyl(meth)acrylate, these comonomers preferably being used in a quantity of from 10 to 70% by weight (based on the polymer).

Improved dispersion properties of the polymer are, however, not characteristic of the present invention. It is quite possible to adjust the dispersion stability, as explained below, by further polymeric addition.

Known ionic or radical polymerisation methods are used for the production of the polymer.

The preferred synthesis method is the radical polymerisation of the ionic monomers. The initiation of polymerisation can take place with the usual radical-formers such as peroxides and preferably azo compounds. A redox polymerisation, for example, by using a peroxide/amine system or a photopolymerisation is also possible. The polymer can be synthesised in the absence of the pigment according to known processes such as bulk, solution, precipitation, suspension or emulsion polymerisation.

According to a preferred embodiment, the polymer is synthesised in the presence of the dispersed pigment, the formed copolymer at least partially entering into a solid physical or chemical bond with the pigment. In this synthesis method, the pigment is used in the form of a nonaqueous 0.5 to 40% dispersion. Aromatic and aliphatic hydrocarbons are primarily suitable as dispersing agent, for example benzene, toluene, xylene, straight and branched $C_6$–$C_{15}$ alkanes as well as cyclohexanes or decalin.

A polymerisation process is preferred in which the pigment dispersion, which can optionally contain a stabilising agent, is cross-linked with basic monomers and optionally comonomers and the polymerisation is initiated by means of a radical-former as starting component.

Soluble high molecular weight compounds such as homo- or mixed polymers of (meth)acrylic acid esters can thereby be used as stabilising agents, for example a 1:1 mixed polymer of isobutylmethacrylate and laurylmethacrylate. Also well suited are mixed polymers with a proportion of from 0.1 to 10% by weight of polymerised monomers with —OH, —COOH, —$NH_2$, —NHR, or —$NR_2$ groups, such as 2-hydroxyethylmethacrylate, (meth)acrylic acid, (meth)acrylamide, N,N-dimethylacrylamide, N,N-dimethylaminoethylmethacrylate and N-vinylpyrrolidone.

Particularly well suited stabilising agents are block copolymers, for example styrene-stearylmethacrylate block copolymers or mercaptan-modified styrene-butadiene block copolymers (DE-A No. 3 412 085).

The polymerisation reaction can be carried out according to a "batch process". In this case, the monomers and the starting components are added all at once to the pigment dispersion and the reaction is initiated by an increase in temperature. A substantially uniform polymer sheath is obtained in this manner.

In a particularly preferred embodiment, the monomers and the starting components are metered in during polymerisation (feed process). It is possible in this embodiment to change the monomer composition over the metering period.

The starting component is likewise advantageously metered in over the reaction period. Solid starting components are effectively dissolved in solvents or monomers.

The copolymer is added in a quantity of from 10 to 300, preferably from 10 to 100% by weight, based on the pigment.

Sulphuric acid mono- and diesters, sulphonic acids, phosphonic acids as well as CH-acidic compounds are above all suitable as Bronsted acids, with the proviso that the Bronsted acid has at least one hydrocarbon radical having from 6 to 24 carbon atoms. Bronsted acids with branched hydrocarbon radicals are preferred. Particularly suitable are Bronsted acids which correspond to the formulae VI, VII, VIII, IX and X:

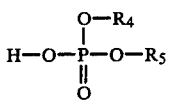

VI

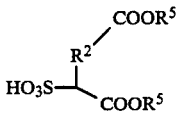

VII

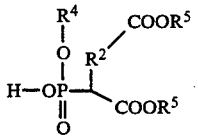

VIII

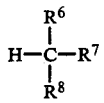

IX

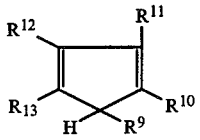

X wherein $R^2$ and $R^4$ are the same or different and represent a hydrocarbon radical having from 1 to 18 carbon atoms, $R^5$=a hydrocarbon radical having from 6 to 24 carbon atoms, $R^6$=—$COOR^5$ or $SO_2R^5$, $R^7$ and $R^8$ are the same or different and represent one of the groups —CN, —$NO_2$, —halogen, —$COOR^5$ or —$SO_2R^5$, $R^9$ to $R^{13}$ are the same or different and represent —$COOR^5$ Examples of suitable Bronsted acids according to the above formulae are:

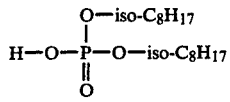

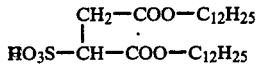

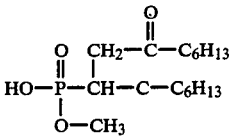

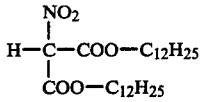

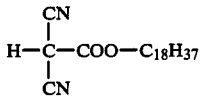

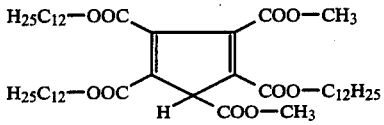

The following are given as preferred Bronsted acids.

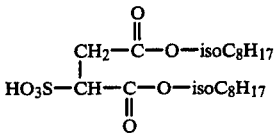

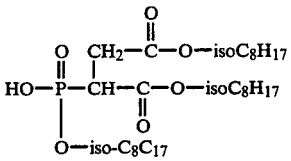

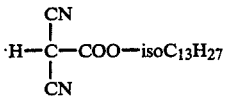

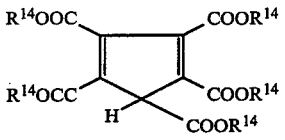

$R^{14}$ = iso $C_{13}H_{27}$

The sulphonic acids, sulphuric acid monoesters, phosphonic acids and phosphoric acid mono- or diesters used as Bronsted acids according to the invention, are accessible from known salts, from which they can be recovered in simple manner by means of ion exchangers.

The new 1,2,3,4,5-pentaalkoxycarbonylcyclopentadienes having $C_6$ to $C_{24}$-hydrocarbon radicals are obtained by ester interchange of the 1,2,3,4,5-pentamethoxycarbonylcyclopentadiene with the corresponding $C_6$ to $C_{24}$-alcohols. During this reaction, the use of an ester interchange catalyst can be dispensed with.

The synthesis of the dicyanoacetic acid esters is carried out by reaction of sodium malodinitrile with chloroformic acid esters in a molar ratio of 2:1 in ethanol as solvent. The sodium salt firstly arising is freed from malodinitrile by digesting with, for example, methylene chloride and is converted into the acidic form by means of an ion exchanger.

The trisalkylsulphonylmethanes having at least one $C_6$ to $C_{24}$-hydrocarbon radical can be synthesised by reacting the corresponding trithioorthoformic esters with peracetic acid in chlorinated hydrocarbons, for example in 1,2-dichloropropane, the isolation of the compounds soluble in the chlorinated hydrocarbon being carried out by distilling off the solvent with addition of water.

The Bronsted acids are generally used in a quantity of from 0.01 to 10% by weight, preferably from 0.1 to 5% by weight, based on the solids content of the suspension developer according to the invention. The quantity for use is thereby measured such that the secondary or tertiary amino groups contained in the polymer are completely or partially neutralised, preferably, however, only partially. The extent of the positive toner charge can be adjusted in simple manner via the type and quantity of the Bronsted acid. In addition to the polymer with secondary or tertiary amino groups, further polymeric additives can be used for the production of the suspension developer according to the invention, for example to increase the dispersion stability for improving the adhesive and fixing properties of the dispersed pigment.

The stabilising agents mentioned further above, based on soluble high molecular weight compounds, are primarily suitable for increasing the dispersion stability.

Resins are suitable as fixing materials, which should be compatible with the binding agent of the photoconductive recording material, for example with the binding agent of a photoconductive zinc oxide layer, so that according to the invention, a good adhesion of the produced image is obtained on the base. Examples of suitable resins are esters of hydrogenated colophonium and fatty oil varnish ("long-oil"), colophonium-modified phenol-formaldehyde resin, pentaerythritol esters of colophonium, glycerol esters of hydrogenated colophonium, ethylcellulose, various alkyd resins, polyacrylic- and polymethacrylic resin, polystyrene, polyketone resin and polyvinyl acetate. Specific examples of such resins can be found in the literature on electrostatographic suspension developers, for example in BE-A No. 699 157 and in GB-A No. 1 151 141.

The suspension developers according to the invention can be produced by conventional dispersing methods. Good results are achieved by using ball mills, bead mills, colloid mills as well as high speed stirrers. It can thereby be favourable to produce a mixture of the pigment, the polymer and the further polymeric additives, firstly, for example, by melting in a kneader, and to disperse this mixture in a second stage of the process in the carrier liquid.

When using the above-described polymerisation process in the presence of the pigment, a stable dispersion is generally directly obtained, so that an additional dispersing stage can be dispensed with.

It is effective to firstly produce a toner concentrate of carrier liquid, pigment and polymer with a content of from 5 to 50% by weight, preferably from 10 to 25% by weight of solids material, which is diluted by addition of further carrier liquid to the concentrations for use of from 0.05 to 2% by weight, preferably from 0.1 to 1% by weight.

The synthesis of suitable Bronsted acids as well as the production and examination of suspensions developers according to the invention is explained in detail in the following Examples.

EXAMPLE 1

Production of pentaisotridecyloxycarbonylcyclopentadiene.

7.13 g (20 mmol) of 1,2,3,4,5-pentamethoxycarbonylcyclopentadiene are treated with 20.0 g (100 mmol) of isotridecyl alcohol. 3.12 g (97.5% of the theoretical yield) of methanol are distilled off at 100° C. within 8 h, firstly at 1013 mbar, then at from 363 to 18 mbar. 24 g of 1,2,3,4,5-pentaisotridecyloxycarbonylcyclopentadiene are obtained.

EXAMPLE 2

Production of dicyanoacetic acid isodecylester.

19.5 g (88.3 mmol) of chloroformic acid isodecyl ester in 20 ml of diethyl ether are added dropwise to 15.0 g (170 mmol) of sodium malodinitrile in 150 ml of absolute ethanol, at −10° C. within 30 min. Heating to room temperature is then allowed to take place and heating is then carried out for 30 min to reflux (68° C.). The precipitate of NaCl 5.7 g (theoretical yield 5.1 g) is filtered off and the filtrate is dried. The residue (26.8 g) is treated with methylene chloride, in order to dissolve out malodinitrile, then drawn off by suction and washed several times with methylene chloride. The precipitate is dried in an oil pump vacuum. 19.5 g (81% of the theoretical yield) of Na-dicyanoacetic acid isodecylester are obtained.

The sodium salt is converted to dicyanoacetic acid isodecyl ester in quantitative yield by means of a cation exchanger.

EXAMPLE 3

A. Production of a modified block polymer.

1 000 ml of cyclohexane, 5 ml of glycol dimethyl ether and 50 g of styrene are added to 2 l glass autoclave with the exclusion of water and oxygen. The mixture is carefully titrated with a 1 molar n-butyllithium solution in n-hexane until a weak yellow colour is obtained. 3 ml of the 1 molar butyllithium solution are then added. The polymerisation temperature is maintained at 40° C. by external cooling. After a reaction time of 60 min, 50 g of butadiene are added and polymerisation is carried out at 50° C. for 60 min. The reaction is thereupon complete. 48 ml of n-dodecylmercaptan and 0.5 g of azodiisobutylronitrile are added and heating takes place for 5 h to 80° C. After cooling to room temperature, the block copolymer with 2 000 ml of ethanol, to which 2 g of 2,6-ditertiary-butyl-p-methyl-phenol have been added, is precipitated from the cyclohexane solution and dried in a vacuum until a constant weight is achieved. 140 g of a colourless block copolymer are obtained. $[\eta]=0.272$ dl/g, toluene, 25° C.; 4.5% by weight of sulphur in the polymer.

B. Production of a pigment dispersion 80 g of helio-fast blue HG (C.I. 74160), 16 g of modified block polymer from A. and 304 g of isododecane are mixed for 16 h in a steel ball mill, a stable dispersion being formed.

C. Polymerisation of a polymer with tertiary amino groups in the presence of the pigment.

100 g of the dispersion from B. and 120 g of isododecane are transferred to a stirring reactor and heated to 80° C. 200 mg of azoisobutyric acid dinitrile are firstly added with effective stirring and flushing with nitrogen and a mixture of 10 g of methyl methacrylate, 10 g of dimethylaminoethylmethacrylate and 100 mg of azoisobutyric acid dinitrile are then immediately metered in an even manner over a period of 60 min. When the addition has ended, the dispersion is maintained with further stirring for 1 h at 80° C. and for 3 h at 90° C.

The dispersion is centrifuged for purifying by means of a cup centrifuge; the formed solids material is isolated and redispersed in 250 g of pure isododecane using a shaking device. This process is repeated once. The dispersion is then adjusted by addition of further isododecane to 0.4% by weight of solids material. The average particle size is 314 nm.

D. Production and examination of the liquid developer.

The dispersion from C is treated with a Bronsted acid. The charge and the charge stability of the dispersed pigment particles (toner particles) is examined by the following test method:

The suspension developer is added to an electrophoresis cell with 2 planar electrodes each with a surface of 20 $cm^2$ and an electrode spacing of 0.15 cm. The electric current, which flows when applying a potential of 500 V for 0.5 s, is measured. The integral of the current over the period of 0.5 s is the Q-value. $Q_T$ is a measure for the charge of the toner particles.

The separation of the toner particles (blue in colour) on the negative electrode (cathode) shows that these are positively charged. The charge stability of the toner particles is checked, by measuring the value $Q_{T1}$ immediately after the production of the liquid developer and $Q_{T2}$ after 7 days storage:

| Bronsted acid | quantity used (% by weight based on solids material) | $Q_{T1}$ [$10^{-8}$ C] | $Q_{T2}$ [$10^{-8}$ C] |
|---|---|---|---|
| acid from Example 1 | 1 | +9 | +8 |
| acid from Example 1 | 2 | +12 | +12 |
| acid from Example 2 | 1 | +4 | +3 |
| succinic acid-isooctyestersulphonic acid | 1 | +4 | +4 |

EXAMPLE 4

Example 3 is repeated, a carbon black pigment with a BET-surface of 30 $m^2/g$ being used in place of helio-fast blue HG (C.I. 74160). The examination gives the following values:

| Bronsted acid | quantity used (% by weight based on solids material) | $Q_{T1}$ [$10^{-8}$ C] | $Q_{T2}$ [$10^{-8}$ C] |
|---|---|---|---|
| acid from Example 1 | 1 | +5 | +5 |
| acid from Example 1 | 2 | +6 | +6 |

EXAMPLE 5

Comparative example with a positive polarising agent according to GB-A 1 151 141

A dispersion is produced in a ball mill from 4 g of carbon black pigment with a BET-surface of 30 $m^2/g$, 1 g of a mixed polymer of 85% of isobutyl methacrylate and 15% of stearyl methacrylate with a molecular weight Mw of 170 000 and in 45 g of isododecane. The dispersion is diluted to a 0.4% solids material, treated with 80 mg of zinc (2-butyl)octylphosphate (produced according to GB-A No. 1 151 141) and examined.

$Q_{T1}$: +23 $10^{-8}$C; $Q_{T2}$: +12 $10^{-8}$C.

We claim:

1. An electrostatographic suspension developer which contains a dispersed pigment and at least one polymer formed from basic, secondary or tertiary amino group-containing monomers, in an electrically insulating carrier liquid with a volume resistivity of at least $10^9$ Ohm.cm and a dielectric constant of below 3, the improvement that the amino-groups of the polymer are completely or partially neutralised with a Bronsted acid, which contains at least one hydrocarbon radical having from 6 to 24 carbon atoms and which is a sulfonic acid, a phosphonic acid, a sulfuric acid monoester, a phosphoric acid mono- or diester or a CH-acid compound, the copolymer being added in a quantity of from 10 to 300% by weight, based on the pigment, the Bronsted acids being added in a quantity of from 0.01 to 10% by weight, based on the solids content of the suspension developer.

2. A suspension developer according to claim 1, characterised in that the amino group-containing monomers correspond to the general formulae

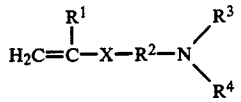

I

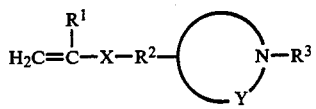

II

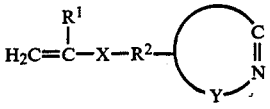

III wherein $R^1$ = a hydrogen atom or a $CH_3$-group, $R^2$ = a hydrocarbon radical having from 1 to 18 carbon atoms, $R^3$ = a hydrogen atom or a hydrocarbon radical having from 1 to 18 carbon atoms, $R^4$ = hydrocarbon radical having from 1 to 18 carbon atoms or $R^3$ and $R^4$ together represent the atoms necessary for the formation of 5- or 6-membered heterocyclic ring, X = one of the groups

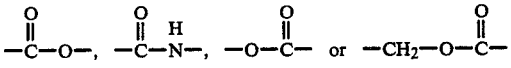

and

Y = the atoms necessary for the completion of a 5- or 6-membered ring.

3. A suspension developer according to claim 2, characterised in that the amino group-containing monomers correspond to the general formula I, wherein X represents one of the groups

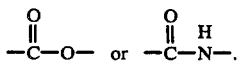

4. A suspension developer according to claims 1, 2 or 3, characterised in that the polymer contains from 1 to 100% by weight, preferably from 10 to 70% by weight, of amino group-containing monomers.

5. A suspension developer according to claim 1, characterised in that the Bronsted acids correspond to the general formulae:

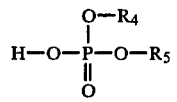

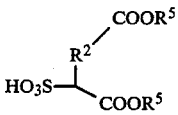

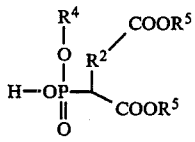

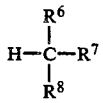

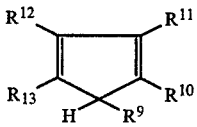

wherein $R^2$ and $R^4$ are the same or different and represent a hydrocarbon radical having from 1 to 18 carbon atoms, $R^5$=hydrocarbon radical having from 6 to 24 carbon atoms.

$R^6$=—$COOR^5$ or —$SO_2R^5$, $R^7$=is the same or different and represents one of the groups —CN, —$NO_2$, —halogen, —$COOR^5$ or —$SO_2R^5$, $R^9$ to $R^{13}$ are the same or different and represent —$COOR^5$.

6. A suspension developer according to claim 4, characterised in that the polymer contains radically polymerisable, olefinically unsaturated polymerised compounds as comonomer.

7. A suspension developer according to claim 6, characterised in that, as comonomer, the polymer contains vinyl or vinylidine compounds of the group (meth)-acrylic acid esters with $C_1$- to $C_{24}$-hydrocarbon radicals in the alcohol moiety, (meth)-acrylic acid amide, (meth)-acrylic acid nitrile, vinyl acetate, vinyl propionate, styrene, α-methyl styrene, butadiene, isoprene, vinyl chloride, vinylidene chloride, ethylene dimethacrylate, divinylbenzene, stearyl methacrylate, lauryl methacrylate and 2-ethylhexyl methacrylate.

8. A suspension developer according to claim 7, characterised in that, as comonomer, the polymer contains from 10 to 70% by weight of a (meth)acrylic acid ester having from 6 to 24 carbon atoms in the alcohol moiety.

9. A suspension developer according to claim 1, characterised in that the proportion of the amino group-containing monomers in the polymer is from 1 to 100% by weight, preferably from 10 to 70% by weight.

10. A process for the production of an electrostatographic suspension developer according to claim 1, characterised in that the amino group-containing monomers are polymerised or are polymerised together with the comonomers in the presence of the pigment in an aliphatic or aromatic hydrocarbon with the properties of the carrier liquid as dispersing agent, thereby forming a pigmented dispersion containing the basic polymer and suitable as a suspension developer.

11. A process according to claim 10, characterised in that the amino group-containing monomers and the comonomers are added to the dispersion of the pigment in the dispersing agent in a feed process, in which in a first polymerisation phase only the comonomers are added and in a second polymerisation phase the monomers are added in admixture with a further quantity of the comonomers.

12. A process according to claim 10, characterised in that the hydrocarbon used as dispersing agent contains a styrene-stearyl-methacrylate- or a mercaptan-modified styrene-butadiene block polymer as stabilising agent.

* * * * *